US009669619B2

(12) United States Patent
Yokota

(10) Patent No.: US 9,669,619 B2
(45) Date of Patent: Jun. 6, 2017

(54) LIQUID EJECTING APPARATUS AND METHOD OF ADJUSTING EJECTED-DROPLET POSITION

(71) Applicant: SEIKO EPSON CORPORATION, Tokyo (JP)

(72) Inventor: So Yokota, Shiojiri (JP)

(73) Assignee: Seiko Epson Corporation, Tokyo (JP)

( * ) Notice: Subject to any disclaimer, the term of this patent is extended or adjusted under 35 U.S.C. 154(b) by 0 days.

(21) Appl. No.: 15/261,050

(22) Filed: Sep. 9, 2016

(65) Prior Publication Data

US 2017/0072680 A1 Mar. 16, 2017

(30) Foreign Application Priority Data

Sep. 11, 2015 (JP) ..... 2015-179646

(51) Int. Cl.
*B41J 11/42* (2006.01)
*B41J 2/045* (2006.01)
*B41J 2/21* (2006.01)

(52) U.S. Cl.
CPC ..... *B41J 2/04505* (2013.01); *B41J 2/04586* (2013.01); *B41J 2/2132* (2013.01)

(58) Field of Classification Search
CPC .. B41J 2/04505; B41J 2/04586; B41J 2/2135; B41J 2/2145; B41J 9/145
See application file for complete search history.

(56) References Cited

U.S. PATENT DOCUMENTS 6,447,098 B2 * 9/2002 Mitsuzawa ..... B41J 2/2135 347/12
6,964,465 B2 * 11/2005 Endo ..... B41J 2/04505 347/19
2003/0016263 A1 1/2003 Takahashi et al.
2016/0089883 A1 3/2016 Yokota
2016/0089918 A1 3/2016 Yokota

FOREIGN PATENT DOCUMENTS

JP 2000-127370 A 5/2000
JP 2015-178202 A 10/2015
JP 2016-064620 A 4/2016
JP 2016-064622 A 4/2016
JP 2016-068435 A 5/2016

* cited by examiner

*Primary Examiner* — Thinh H Nguyen
(74) *Attorney, Agent, or Firm* — Foley & Lardner LLP

(57) ABSTRACT

A first pattern and second patterns, having a plurality of sub-patterns, are formed while an ejector is moved in a forward direction, and a third pattern and fourth patterns are formed while the ejector is moved in a backward direction. The third pattern has sub-patterns deviating in sequence from the respective sub-patterns of the first pattern in the first directions by a first deviation amount. The fourth patterns each have sub-patterns deviating in sequence from the respective sub-patterns of the second patterns in the first directions by a second deviation amount. The positions of sub-patterns of a rough adjustment pattern, including the first and the third pattern, and the positions of sub-patterns of fine adjustment patterns, including the second and the fourth patterns, are associated with each other. In each fine adjustment pattern, image density periodically changes along the first directions and one or more cycles of periodic changes are included.

8 Claims, 10 Drawing Sheets

N
G1
G2
G3
G4
G5
P2, Pd−1 RECORD
P2, Pd−1 RECORD
P1, Pr RECORD
P2, Pd−2 RECORD
P2, Pd−2 RECORD
P4, Pd−1 RECORD
P4, Pd−1 RECORD
P3, Pr RECORD
P4, Pd−2 RECORD
P4, Pd−2 RECORD
B1
B2
A

LIQUID EJECTING APPARATUS AND METHOD OF ADJUSTING EJECTED-DROPLET POSITION

BACKGROUND

1. Technical Field

The invention relates to a liquid ejecting apparatus and a method of adjusting ejected-droplet positions.

2. Related Art

Liquid ejecting apparatuses such as recording apparatuses ejecting ink or other liquid droplets toward recording media, for example, have been in common use. These liquid ejecting apparatuses typically involve adjustment of the positions of liquid droplets on a medium before the liquid droplets are ejected toward the medium.

For example, JP-A-2000-127370 discloses a printer (liquid ejecting apparatus) that conducts rough adjustment and then fine adjustment of the positions of liquid droplets on the medium.

However, it takes much time to individually form different adjustment patterns such as a rough adjustment pattern and then a fine adjustment pattern. This is generally because maintenance of the ejector is performed before and after formation of each adjustment pattern so that ink (liquid) droplets can be appropriately ejected. This is the reason why such adjustment of the positions of liquid droplets on a medium requires a long period of time.

SUMMARY

An advantage of some aspects of the invention is that the time required for adjustment of the positions of liquid droplets on a medium is shortened.

A liquid ejecting apparatus according to a first aspect of the invention is a liquid ejecting apparatus including: an ejector that includes nozzle lines that eject liquid droplets and is movable forward and backward in first directions intersecting the nozzle lines; a moving unit that causes a medium and the ejector to move relatively to each other in a second direction intersecting the first directions; and a controlling unit that is operated to form a first pattern and second patterns, having a plurality of sub-patterns arranged in the first directions, on the medium while the liquid droplets are ejected from the ejector and the ejector is moved in a forward direction of the first directions, and to form a third pattern and fourth patterns on the medium while the liquid droplets are ejected from the ejector and the ejector is moved in a backward direction of the first directions, the third pattern having sub-patterns deviating in sequence from the respective sub-patterns of the first pattern in the first directions by a first deviation amount, the fourth patterns each having sub-patterns deviating in sequence from the respective sub-patterns of the second patterns in the first directions by a second deviation amount smaller than the first deviation amount. Positions of sub-patterns of at least one rough adjustment pattern, including the first pattern and the third pattern, and positions of sub-patterns of fine adjustment patterns, including the second patterns and the fourth patterns, in the first directions are associated with each other. In each fine adjustment pattern, image density periodically changes along the first directions in accordance with deviation of the sub-patterns of the fourth patterns formed on the medium in sequence from the respective sub-patterns of the second patterns by the second deviation amount, and the fine adjustment patterns each include one or more cycles of the periodic changes.

In this case, the first pattern and the second patterns, having a plurality of sub-patterns arranged in the first directions, are formed on the medium while the ejector is moved in the forward direction, and the third pattern and the fourth patterns are formed on the medium while the ejector is moved in the backward direction, the third pattern having sub-patterns deviating in sequence from the respective sub-patterns of the first pattern in the first directions by the first deviation amount, the fourth patterns each having sub-patterns deviating in sequence from the respective sub-patterns of the second patterns in the first directions by the second deviation amount smaller than the first deviation amount. In other words, the rough adjustment pattern, including the first pattern and the third pattern, and the fine adjustment patterns, including the second patterns and the fourth patterns, are formed concurrently with forward and backward motion of the recording head. Accordingly, one operation of forming adjustment patterns allows both the rough adjustment pattern and the fine adjustment patterns to be formed, thereby shortening the time to adjust the positions of ink droplets on the medium.

It should be noted that the positions of liquid droplets on the medium are conventionally adjusted by forming the rough adjustment pattern for major adjustment and then forming fine adjustment patterns for minor adjustment. This is because each fine adjustment pattern, which is highly accurate, gives a small adjustment area and the small adjustment area does not fall every time within the intended adjustment area unless major adjustment is performed before formation of the fine adjustment patterns. Accordingly, only with the fine adjustment patterns, adjustment itself of the positions of liquid droplets on the medium may not be achieved. Naturally, only with adjustment using the rough adjustment pattern, the adjustment accuracy decreases.

In contrast, according to the aspect of the invention, the positions of the sub-patterns of the rough adjustment pattern and those of each fine adjustment pattern in the first directions are associated with each other, and each fine adjustment pattern exhibits the image density that periodically changes along the first directions and includes one or more cycles of such periodic changes. In other words, use of the rough adjustment pattern enables adjustment of the positions of liquid droplets on the medium within a larger adjustment area, while use of the fine adjustment patterns enables highly accurate adjustment within the adjustment area related to the rough adjustment pattern.

Consequently, the aspect accomplishes highly accurate adjustment of the positions of liquid droplets on the medium and shortens the time required for the adjustment.

According to the aspect, the fine adjustment patterns may each include two or more cycles of the periodic changes.

In this case, the fine adjustment patterns each include two or more cycles of the periodic changes. This extends the adjustment area, which resides in the fine adjustment patterns and is related to the rough adjustment pattern, in the first directions and increases at least one of the area and accuracy for the adjustment of the positions of liquid droplets on the medium.

According to the aspect, the fine adjustment patterns may be disposed on both sides of the at least one rough adjustment pattern in the second direction.

In this case, the fine adjustment patterns are disposed on both sides of the at least one rough adjustment pattern in the second direction. In other words, a plurality of (at least two) fine adjustment patterns can be formed. The fine adjustment patterns, which are used for highly accurate adjustment, are prone to variations. Since adjustment using data on a plurality of portions can give high accuracy, particularly highly accurate adjustment of the positions of liquid droplets on the medium can be achieved.

According to the aspect, the at least one rough adjustment pattern may include a plurality of rough adjustment patterns that are disposed on both sides of the fine adjustment pattern in the second direction.

In this case, the at least one rough adjustment pattern includes a plurality of rough adjustment patterns that are disposed on both sides of the fine adjustment pattern in the second direction. In other words, the fine adjustment pattern can be formed with nozzles in a middle part of each nozzle line. When the fine adjustment pattern, which is used for highly accurate adjustment, is formed with nozzles in the middle part, which barely cause variations, the adjustment accuracy tends to increase. Accordingly, particularly highly accurate adjustment of the positions of liquid droplets on the medium can be achieved.

According to the aspect, the positions of the sub-patterns of the at least one rough adjustment pattern and the positions of the sub-patterns of the fine adjustment patterns in the first directions may be associated with each other such that a selection area in each fine adjustment pattern is selected according to selection of a selection position in the at least one rough adjustment pattern, and the controlling unit may set an adjustment value based on a reference value within the selection area.

In this case, the positions of the sub-patterns of the rough adjustment pattern and those of the fine adjustment patterns in the first directions are associated with each other so that a selection area in each fine adjustment pattern can be selected according to the selection of a selection position in the rough adjustment pattern, and an adjustment value is set based on a reference value within the selection area. In other words, selection of a selection position in the rough adjustment pattern facilitates selection of a selection area for the reference value in each fine adjustment pattern. It should be noted that a "reference value" includes not only magnitude of number but also an information value such as a data number representing information on the position of a sub-pattern.

According to the aspect, the selection area dependent on the selection position may be changeable.

In this case, the selection area dependent on the selection position is changeable. Accordingly, when a selection area in the fine adjustment pattern is not appropriately selected based on the selection position in the rough adjustment pattern, the selection area dependent on the selection position can be changed to an appropriate area. This enables particularly highly accurate adjustment of the positions of liquid droplets on the medium.

According to the aspect, the controlling unit may set the adjustment value by determination of the reference value given by information on the periodic changes outside of the selection area.

In this case, the adjustment value can be set by determination of the reference value given by information on the periodic changes outside of the selection area. In other words, when, for example, a selection area in the fine adjustment pattern selected according to the selection of a selection position in the rough adjustment pattern is not large enough to set an appropriate adjustment value, an appropriate adjustment value that reflects the results (an appropriate reference value) given by information outside of the selection area can be set. This enables particularly highly accurate adjustment of the positions of liquid droplets on the medium.

A method of adjusting ejected-droplet positions according to a second aspect of the invention uses a liquid ejecting apparatus including: an ejector that includes nozzle lines that eject liquid droplets and is movable forward and backward in first directions intersecting the nozzle lines; and a moving unit that causes a medium and the ejector to move relatively to each other in a second direction intersecting the first directions. The method includes: forming a forward pattern including a first pattern and second patterns, having a plurality of sub-patterns arranged in the first directions, on the medium while the liquid droplets are ejected from the ejector and the ejector is moved in a forward direction of the first directions; and forming a backward pattern including a third pattern and fourth patterns on the medium while the liquid droplets are ejected from the ejector and the ejector is moved in a backward direction of the first directions, the third pattern having sub-patterns deviating in sequence from the respective sub-patterns of the first pattern in the first directions by a first deviation amount, the fourth patterns each having sub-patterns deviating in sequence from the respective sub-patterns of the second patterns in the first directions by a second deviation amount smaller than the first deviation amount. Positions of sub-patterns of at least one rough adjustment pattern, including the first pattern and the third pattern, and positions of sub-patterns of fine adjustment patterns, including the second patterns and the fourth patterns, in the first directions are associated with each other. In each fine adjustment pattern, image density periodically changes along the first directions in accordance with deviation of the sub-patterns of the fourth patterns formed on the medium in sequence from the respective sub-patterns of the second patterns by the second deviation amount. The fine adjustment patterns each include one or more cycles of the periodic changes.

In this case, the rough adjustment pattern, including the first pattern and the third pattern, and the fine adjustment patterns, including the second patterns and the fourth patterns, are formed concurrently with forward and backward motion of the recording head. Accordingly, one operation of forming adjustment patterns allows both the rough adjustment pattern and the fine adjustment patterns to be formed, thereby shortening the time to adjust the positions of ink droplets on the medium.

In addition, in this case, the positions of the sub-patterns of the rough adjustment pattern and those of each fine adjustment pattern in the first directions are associated with each other, and each fine adjustment pattern exhibits the image density that periodically changes along the first directions and includes one or more cycles of such periodic changes. In other words, use of the rough adjustment pattern enables adjustment of the positions of liquid droplets on the medium within a larger adjustment area, while use of the fine adjustment patterns enables highly accurate adjustment within the adjustment area related to the rough adjustment pattern.

Consequently, the aspect accomplishes highly accurate adjustment of the positions of liquid droplets on the medium and shortens the time required for the adjustment.

BRIEF DESCRIPTION OF THE DRAWINGS

The invention will be described with reference to the accompanying drawings, wherein like numbers reference like elements.

DESCRIPTION OF EXEMPLARY EMBODIMENTS

A recording apparatus given as a liquid ejecting apparatus according to an embodiment of the invention will now be described in detail with reference to the attached drawings.

A summary of the recording apparatus according to an embodiment of the invention will be first described.

Figure 1:
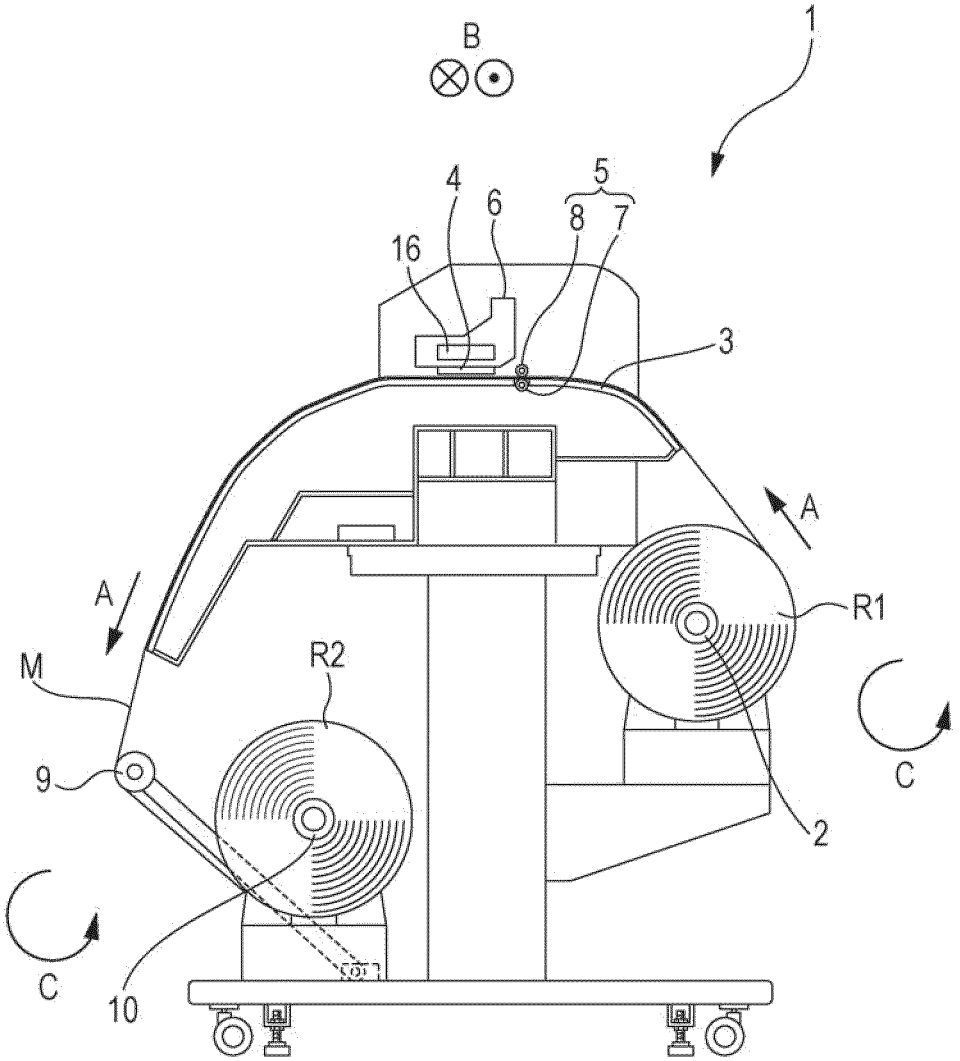
FIG. 1 is a schematic side view of a recording apparatus according to an embodiment of the invention.

FIG. 1 is a schematic side view of a recording apparatus 1 according to this embodiment.

The recording apparatus 1 of this embodiment includes a support shaft 2 supporting a roll R1 of a rolled recording medium (medium) M. In the recording apparatus 1 of this embodiment, the support shaft 2 rotates in a rotation direction C during transport of the recording medium M in a transport direction A. It should be noted that this embodiment uses the rolled recording medium M reeled in such a way that the recording surface faces outside. In the case of use of the rolled recording medium M reeled in such a way that the recording surface faces inside, the roll R1 can be fed by rotation of the support shaft 2 in the direction opposite to the rotation direction C.

The recording apparatus 1 of this embodiment is used with a rolled recording medium as the recording medium M but is not limited to a recording apparatus used with such a rolled recording medium. A recording medium in the form of single-cut sheets, for example, can be an alternative.

The recording apparatus 1 of this embodiment includes a pair of transporting rollers 5 serving as a moving unit and including a driving roller 7 and a driven roller 8. The pair of transporting rollers 5 is used to transport the recording medium M in a transport direction A along a transport path for the recording medium M passing through a medium supporter 3 and other components.

In the recording apparatus 1 of this embodiment, the driving roller 7 is composed of a single roller extending in a direction B that intersects the transport direction A in which the recording medium M is transported, while the driven roller 8 is composed of a plurality of rollers that are arranged in the direction B and face the driving roller 7.

The recording apparatus 1 of this embodiment includes a moving unit (the pair of transporting rollers 5) for transporting the recording medium M in the transport direction A toward the recording head 4, but may alternatively include any moving unit that causes the recording medium M and the ejector to move relatively to each other and therefore may be a flat-bed type recording apparatus that causes the ejector to move relatively to the recording medium M.

A heater (not shown in the drawing) that can heat the recording medium M supported by the medium supporter 3 is provided below the medium supporter 3. The recording apparatus 1 of this embodiment includes such a heater that can heat the recording medium M from the medium supporter 3 side but may alternatively include an infrared heater, for example, that faces the medium supporter 3.

The recording apparatus 1 of this embodiment also includes a recording head 4 that serves as an ejector with a nozzle surface provided with a plurality of nozzles from which ink droplets are ejected for recording, and a carriage 6, on which the recording head 4 is mounted, movable forward and backward in the direction B.

The carriage 6 is also provided with a sensor 16 that detects ink droplets ejected from the recording head 4 toward the recording medium M. Moving the carriage 6 in the direction B allows the recording medium M to be fully read in the width direction corresponding to the direction B.

A reeling shaft 10 that can reel the recording medium M as a roll R2 is provided in the downstream of the recording head 4 in the transport direction A in which the recording medium M is transported. Since this embodiment involves reeling the recording medium M in such a way that the recording surface faces outside, the reeling shaft 10 rotates in the rotation direction C while the recording medium M is reeled. If the recording medium M is reeled in such a way that the recording surface faces inside, the reeling shaft 10 can reel it by rotating in a direction opposite to the rotation direction C.

A tension bar 9 is provided between the downstream end (in the transport direction A in which the recording medium M is transported) of the medium supporter 3 and the reeling shaft 10. The tension bar 9 has an area extending in the direction B and being in contact with the recording medium M. The tension bar 9 can give the recording medium M a desired level of tension.

The electrical configuration of the recording apparatus 1 of this embodiment will now be described.

Figure 2:
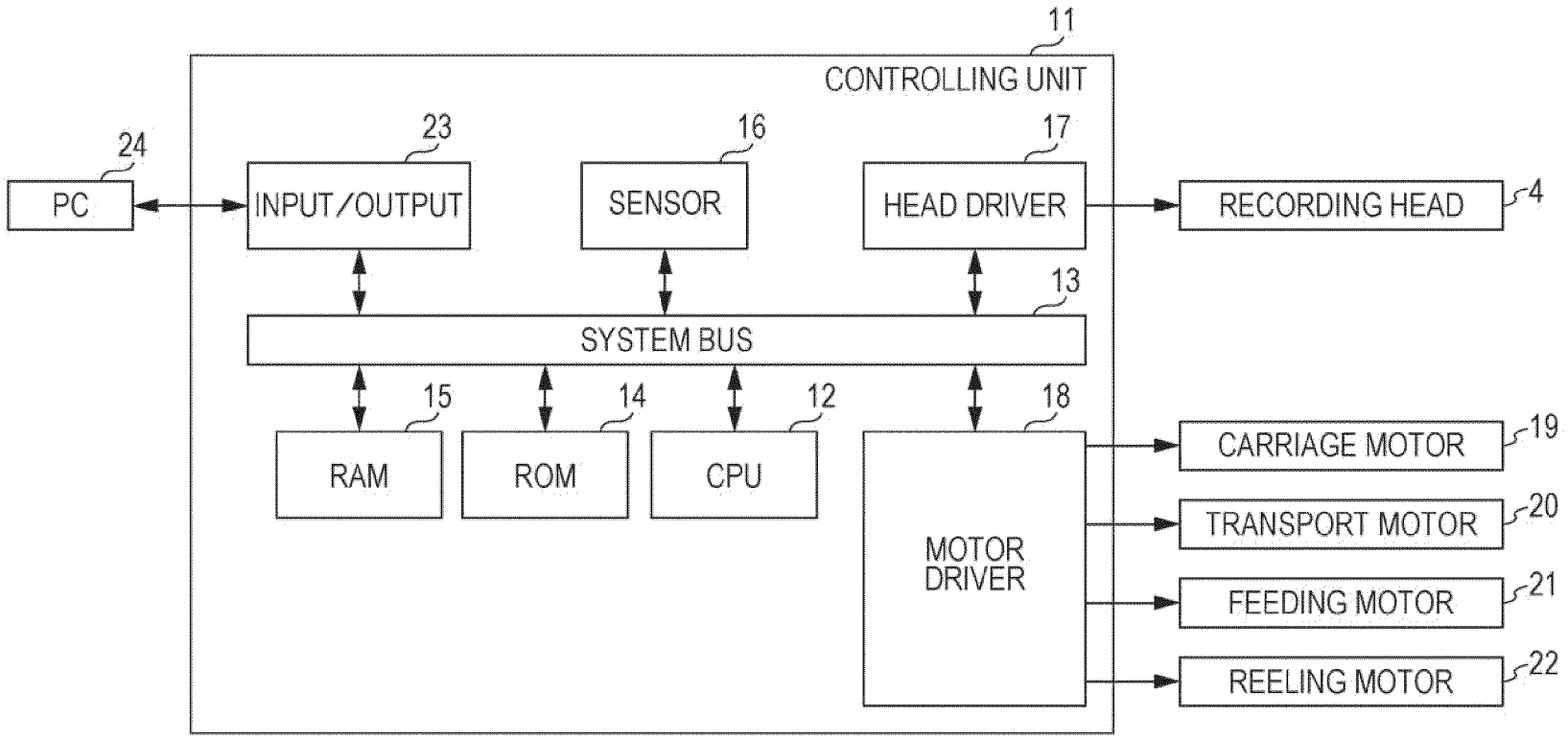
FIG. 2 is a block diagram of the recording apparatus according to an embodiment of the invention.

FIG. 2 is a block diagram of the recording apparatus 1 of this embodiment.

A controlling unit 11 includes a CPU 12 that controls the entire recording apparatus 1. The CPU 12 is connected to a ROM 14 that stores, for example, various control programs to be executed by the CPU 12, and to a RAM 15 that can temporarily store data via a system bus 13.

The CPU 12 is also connected to the sensor 16 via the system bus 13.

The CPU 12 is also connected to a head driver 17 for driving the recording head 4, via the system bus 13.

The CPU 12 is also connected to a motor driver 18 that is connected to a carriage motor 19, a transport motor 20, a feeding motor 21, and a reeling motor 22 via the system bus 13.

The carriage motor 19 here is a motor that moves the carriage 6, on which the recording head 4 is mounted, in the direction B. The transport motor 20 is a motor that drives the driving roller 7 of the pair of transporting rollers 5. The feeding motor 21 is a unit that rotates the support shaft 2 and is a motor that drives the support shaft 2 in order to feed the recording medium M to the pair of transporting rollers 5. The reeling motor 22 is a drive motor that rotates the reeling shaft 10.

The CPU 12 is also connected to an input/output unit 23 via the system bus 13. The input/output unit 23 is connected to a PC 24 so that the CPU 12 can transmit/receive recorded or other types of data and signals to/from the PC 24.

The controlling unit 11 of this embodiment with such a configuration can control the recording head 4 serving as an ejector, the driving roller 7 serving as a transport roller of the transport unit, the carriage 6, and other components.

Control of the recording head 4, the driving roller 7, the carriage 6, and other components by the controlling unit enables recording while a predetermined amount of transport of the recording medium M and ink ejection by the recording head 4 moving in the direction B are alternately repeated.

The recording head 4 of this embodiment will now be described.

Figure 3:
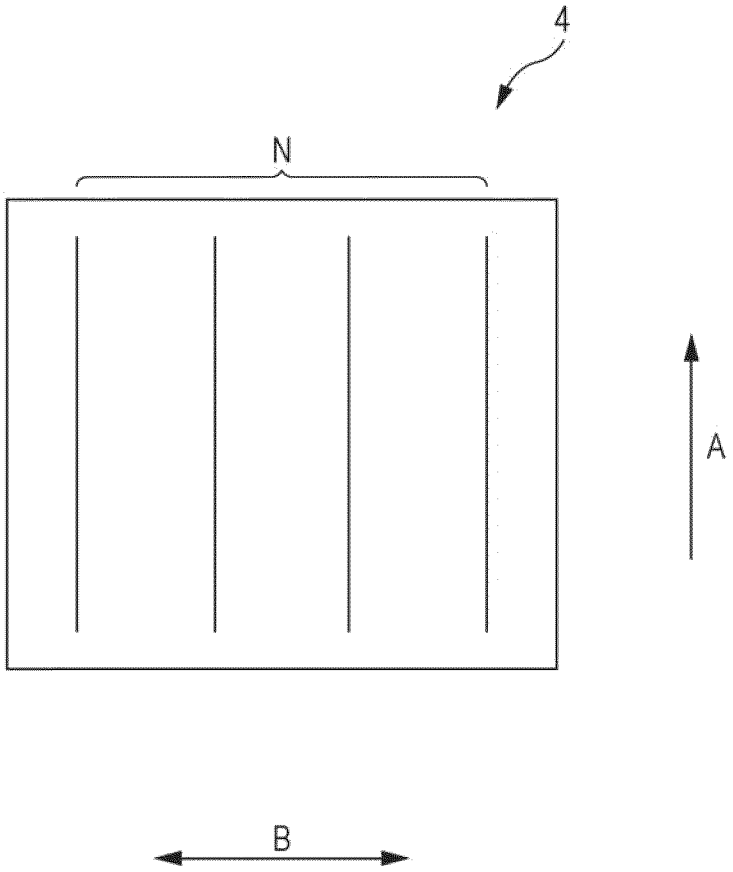
FIG. 3 is a schematic bottom view of a recording head of the recording apparatus according to an embodiment of the invention.

FIG. 3 is a bottom view of the recording head 4 of this embodiment.

Referring to FIG. 3, the recording head 4 of this embodiment includes nozzle lines N from which ink droplets, exemplary liquid droplets, are ejected. Each nozzle line N includes a plurality of nozzles arranged in the transport direction A. The recording head 4 of this embodiment can move along with the carriage 6 forward and backward in the directions B corresponding to the first directions that intersects the nozzle lines N.

It should be noted that the transport direction A, which intersects the directions B corresponding to the first directions, corresponds to the second direction.

An ejected-ink droplet position adjustment pattern P for the recording apparatus 1 of this embodiment will now be described.

Figure 4:
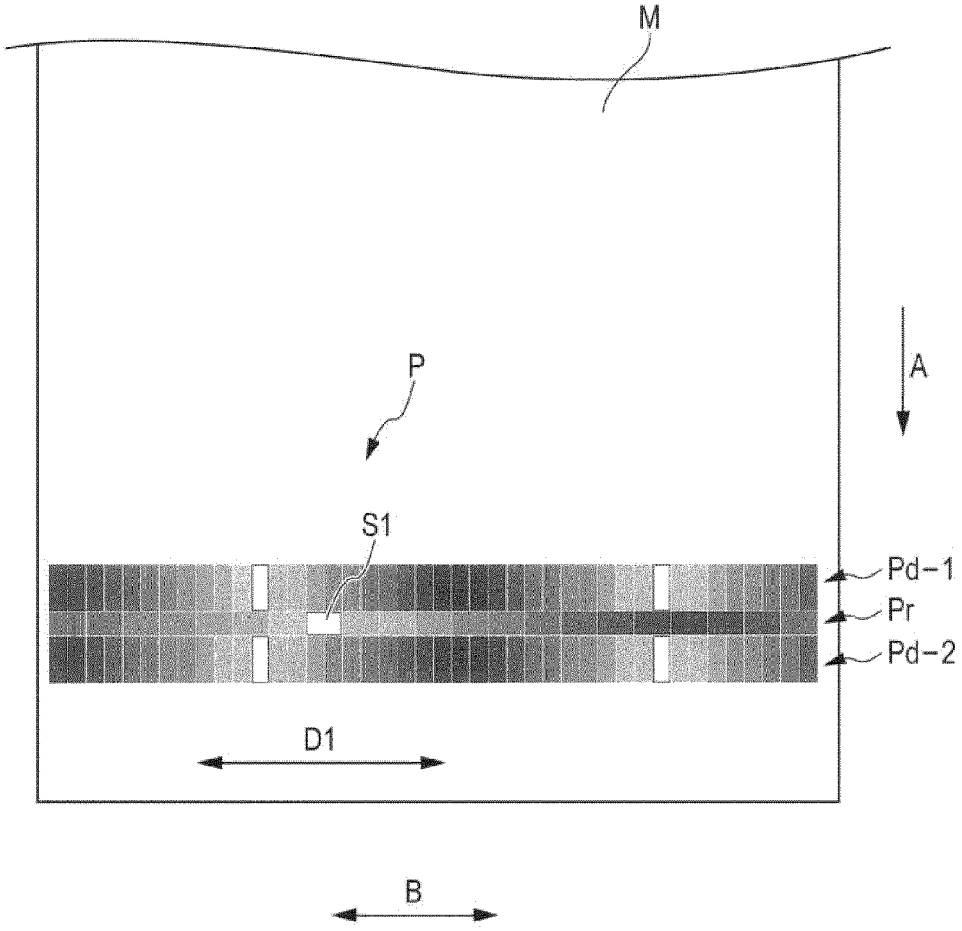
FIG. 4 is a schematic diagram of an adjustment pattern for the recording apparatus according to an embodiment of the invention.
Figure 5B:
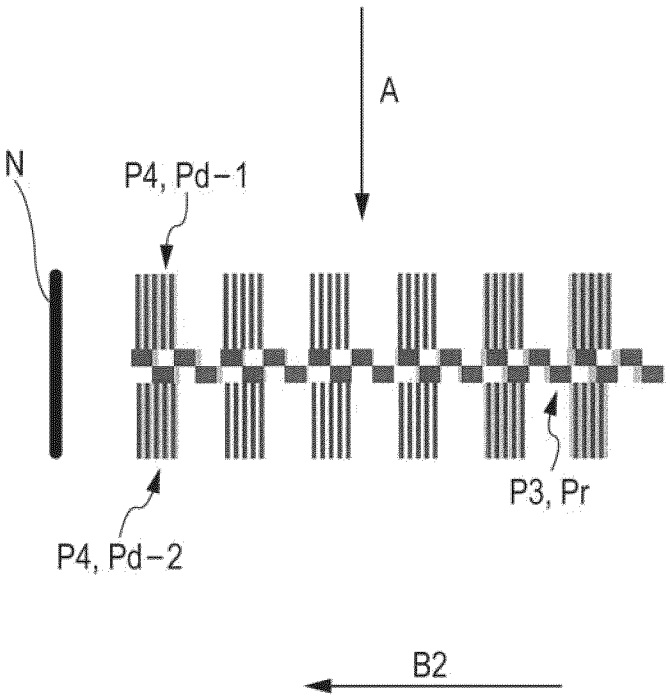
FIGS. 5A and 5B are schematic diagrams of the adjustment pattern for the recording apparatus according to an embodiment of the invention.
Figure 5A:
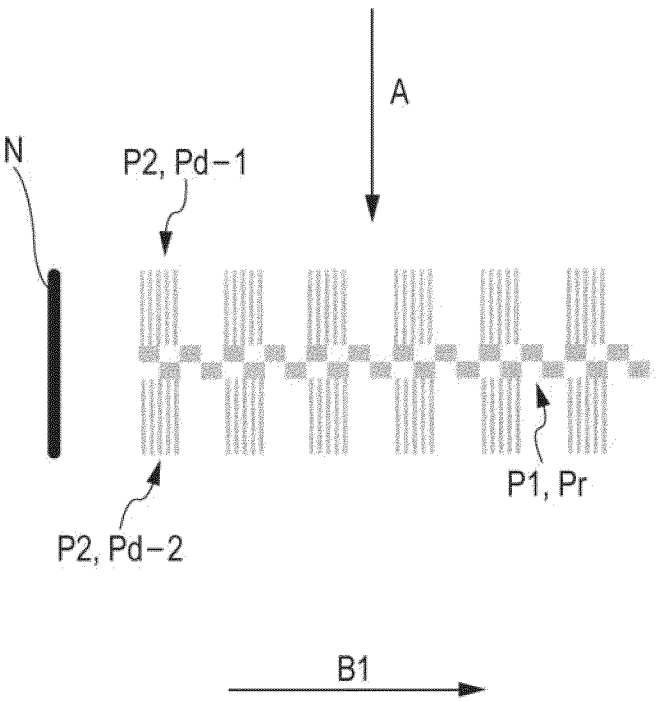
Figures 6A, 6B:
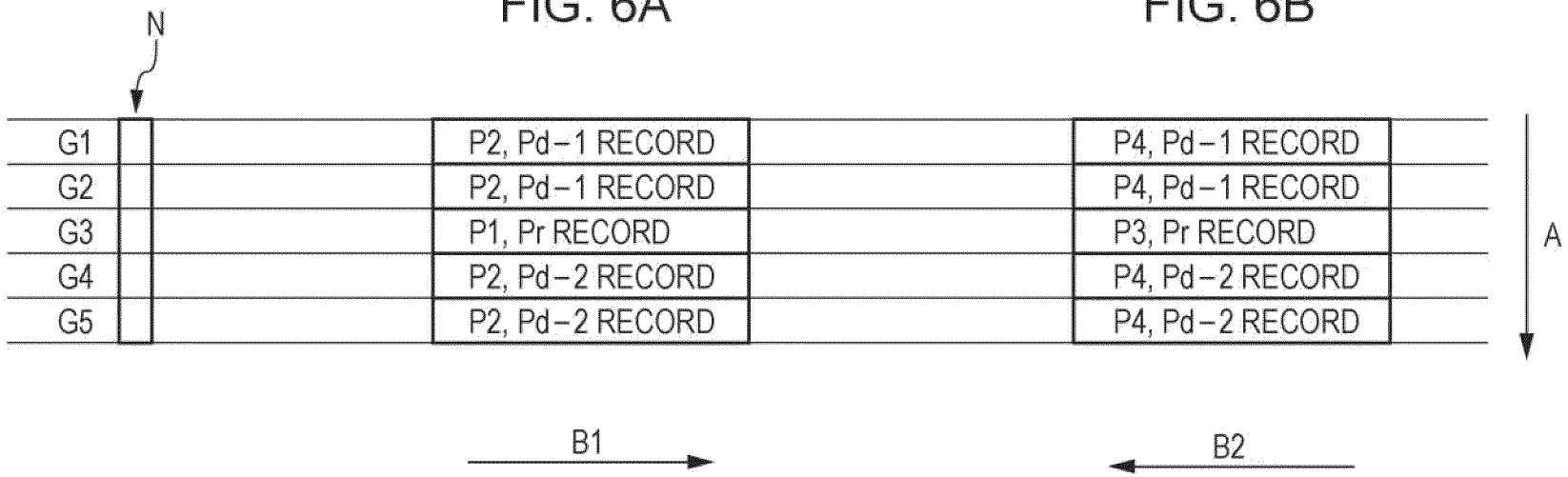
FIGS. 6A and 6B are schematic diagrams of the adjustment pattern for the recording apparatus according to an embodiment of the invention.

FIG. 4 is a general schematic view of the adjustment pattern P formed by the recording apparatus 1 of this embodiment. FIGS. 5A and 5B illustrate the details of a part of the adjustment pattern P. FIGS. 6A and 6B illustrate a correspondence relation between the position of the adjustment pattern P and the positions of the nozzles used to form the adjustment pattern P. FIGS. 7A to 7C, FIGS. 8A to 8C, and FIGS. 9A to 9C are schematic diagrams for explaining an example method of adjusting ejected-droplet positions applicable to the recording apparatus 1 of this embodiment.

The recording apparatus 1 of this embodiment can form images (cause ink droplets to be ejected) by forward and backward motion of the recording head 4 in the directions B, specifically, in both the forward direction B1 and the backward direction B2. The adjustment pattern P of this embodiment is a pattern (so-called forward and backward adjustment pattern) for adjusting ejected-ink droplet positions, which are determined by motion of the recording head 4 in the backward direction B2, with respect to other ejected-ink droplet positions, which are determined by motion of the recording head 4 in the forward direction B1.

As illustrated in FIG. 4 and FIGS. 5A and 5B, the adjustment pattern P formed by the recording apparatus 1 of this embodiment includes a rough adjustment pattern Pr and fine adjustment patterns Pd (fine adjustment patterns Pd-1 and Pd-2). Specifically, the fine adjustment patterns Pd are formed on both sides of each rough adjustment pattern Pr in the transport direction A.

As illustrated in FIGS. 5A and 5B, in this embodiment, the rough adjustment pattern Pr includes a plurality of block sub-patterns arranged in the direction B in two rows in a staggered configuration, and the fine adjustment patterns Pd each include a plurality of line sub-patterns arranged in the direction B. The width of each sub-pattern of the fine adjustment patterns Pd in the direction B is smaller than the width of each sub-pattern of the rough adjustment pattern Pr in the direction B. The adjustment resolution at the ejected-ink droplet positions in the fine adjustment patterns Pd is higher than that of the ejected-ink droplet positions in the rough adjustment pattern Pr. It should be noted that the adjustment resolution of an ejected-ink droplet position in the rough adjustment pattern Pr is preferably determined by the imaginable maximum deviation (so-called deviation due to production error) of ejected-ink droplet positions given by the recording apparatus 1. The adjustment resolution at the ejected-ink droplet positions in the fine adjustment patterns Pd is preferably determined by the allowable maximum deviation (the allowable deviation depending on the image quality) given by the recording apparatus 1. Although the rough adjustment pattern Pr of this embodiment includes block sub-patterns and the fine adjustment patterns Pd of this embodiment include line sub-patterns, there are no limitations on the shapes of the sub-patterns of the rough adjustment pattern Pr and the fine adjustment patterns Pd.

FIG. 5A illustrates a forward direction pattern formed by motion of the recording head 4 in the forward direction B1, together with the position of the corresponding nozzle line N. FIG. 5B illustrates a backward direction pattern formed by motion of the recording head 4 in the backward direction B2 after the forward direction pattern is formed, together with the position of the corresponding nozzle line N in the same manner as FIG. 5A.

It should be noted that FIGS. 5A and 5B illustrate the forward direction pattern in gray and the backward direction pattern in black to help visual recognition. In the drawing, the direction B1 and the direction B2 and the forward direction and the backward direction of the recording head 4 can be reversed.

As illustrated in FIGS. 5A and 5B, the forward direction pattern includes a first pattern P1 for the rough adjustment pattern Pr and second patterns P2 for the fine adjustment patterns Pd. The backward direction pattern includes a third pattern P3 for the rough adjustment pattern Pr and fourth patterns P4 for the fine adjustment patterns Pd.

The first pattern P1 includes block sub-patterns arranged with predetermined intervals. The second patterns P2 include line sub-patterns arranged with predetermined intervals. The third pattern P3 includes block sub-patterns that deviate in sequence by a predetermined amount (a first deviation amount) from the respective sub-patterns of the first pattern P1 in the direction B. The fourth patterns P4 include line sub-patterns that deviate in sequence a predetermined amount (a second deviation amount) from the respective sub-patterns of the second patterns P2 in the direction B. FIG. 5B indicates a situation where the sub-patterns of the third pattern P3 and the fourth patterns P4 deviate in sequence by a predetermined deviation amount from the respective sub-patterns of the first pattern P1 and the second patterns P2, and the deviation increases more to the right by a predetermined amount as the position of the sub-pattern gets closer to the right. In particular, the predetermined deviation amount by which the sub-patterns of the third pattern P3 deviate in sequence from the respective sub-patterns of the first pattern P1 (the predetermined deviation amount set for the rough adjustment pattern Pr) is larger than the predetermined deviation amount by which the sub-patterns of the fourth patterns P4 deviate in sequence from the respective sub-patterns of the second patterns P2 (the predetermined deviation amount set for each fine adjustment pattern Pd).

Here, the shorter the deviation amount by which the sub-patterns of the third pattern P3 deviate in sequence from the respective sub-patterns of the first pattern P1, the lower the image density of the rough adjustment pattern Pr including the first pattern P1 and the third pattern P3. Similarly, the shorter the deviation amount by which the sub-patterns of the fourth patterns P4 deviate in sequence from the respective sub-patterns of the second patterns P2, the lower the image density of the fine adjustment patterns Pd including the second patterns P2 and the fourth patterns P4. For instance, referring to FIG. 5B, for both the rough adjustment pattern Pr and each fine adjustment pattern Pd, the third block, including block sub-patterns and line sub-patterns, from the left exhibits the smallest deviation amount, and the deviation amount increases as the distance from that block increases. Referring to FIG. 5B based on this fact, for both the rough adjustment pattern Pr and each fine adjustment pattern Pd, the third block from the left exhibits the lowest image density, and the image density increases as the distance from that block increases.

The recording apparatus 1 of this embodiment adjusts the ejected-ink droplet positions related to motion of the recording head 4 in the backward direction B2 with respect to the ejected-ink droplet positions related to motion of the recording head 4 in the forward direction B1, based on the image density and position of each sub-pattern of the rough adjustment pattern Pr and each fine adjustment pattern Pd arranged in the direction B.

FIG. 4 schematically illustrates the distribution of the image densities of the sub-patterns of the rough adjustment pattern Pr and each of the fine adjustment patterns Pd arranged in the direction B. As described above, the recording apparatus 1 of this embodiment includes the sensor 16 which reads (measures) the image density of each sub-pattern. In this embodiment, the ejected-ink droplet positions are adjusted based on the position of the sub-pattern with the lowest image density read by the sensor 16 (the position of the sub-pattern at the lowest peak of image density). Naturally, in contrast to the recording apparatus 1 of this embodiment, the ejected-ink droplet positions may be adjusted based on the position of the sub-pattern with the highest image density.

As illustrated in FIG. 4, for the adjustment pattern P of this embodiment, the number of cycles (about two cycles) with the highest and lowest image densities in each fine adjustment pattern Pd is larger than the number of cycles (about one cycle) with the highest and lowest image densities in the rough adjustment pattern Pr. In the adjustment pattern P of this embodiment, the positions of the sub-patterns of the rough adjustment pattern Pr and those of each fine adjustment pattern Pd are associated with each other.

The fine adjustment patterns Pd exhibit high adjustment resolutions leading to a reduction in the predetermined amount of deviation by which the sub-patterns of the backward direction pattern deviate in sequence from the respective sub-patterns of the forward direction pattern. Hence, to increase the adjustment area, one or more cycles each including the highest and lowest image densities are needed. However, when there are two cycles each including the highest and lowest image densities, it may not be determined which among the two lowest peaks of image density is a correct peak position or a peak position that deviates from the correct peak position by one cycle. Therefore, in the adjustment pattern P of this embodiment, the positions of the sub-patterns of the rough adjustment pattern Pr and those of each fine adjustment pattern Pd are associated with each other, so that even when, for example, there are two cycles including the highest and lowest image densities, which among the two lowest peaks of image density is a correct peak position can be determined based on information on the rough adjustment pattern Pr.

When the adjustment area is increased to give at least one cycle (about two cycles in this embodiment) including the highest and lowest image densities in each fine adjustment pattern Pd, the risk of absence of a correct peak position in the cycles including the highest and lowest image densities in each fine adjustment pattern Pd decreases.

In the adjustment pattern P of this embodiment, the positions of the sub-patterns of the rough adjustment pattern Pr and those of each fine adjustment pattern Pd are associated with each other in the following manner.

As illustrated in FIG. 4, a selection position S1 of the rough adjustment pattern Pr with the lowest image density is selected and a peak position with the lowest image density is specified from a selection area D1, which is associated with the selected selection position S1, in each fine adjustment pattern Pd.

In summary of the description so far, the recording apparatus 1 of this embodiment includes the recording head 4 that has nozzle lines N that eject ink droplets and that can move forward and backward in the first directions (direction B) intersecting the nozzle lines N, and the pair of transporting rollers 5 that transports the recording medium M in the second direction (transport direction A) intersecting the first directions (i.e., causes the recording medium M and the recording head 4 to move relatively to each other).

The controlling unit 11 is operated to form a first pattern P1 and second patterns P2, which have a plurality of sub-patterns arranged in the first directions, on the recording medium M while ink droplets are ejected from the recording head 4 and the recording head 4 is moved in the forward direction B1, and to form a third pattern P3, which has sub-patterns deviating in sequence from the respective sub-patterns of the first pattern P1 in the first directions by the first deviation amount, and fourth patterns P4, each of which has sub-patterns deviating in sequence from the respective sub-patterns of the second patterns P2 in the first directions by the second deviation amount smaller than the first deviation amount, on the recording medium M while ink droplets are ejected from the recording head 4 and the recording head 4 is moved in the backward direction B2. Here, the positions of the sub-patterns of the rough adjustment pattern Pr, including the first pattern P1 and the third pattern P3, and those of the fine adjustment patterns Pd, including the second patterns P2 and the fourth patterns P4, in the first directions are associated with each other. In each fine adjustment pattern Pd, the image density periodically changes along the first directions because the sub-patterns of the fourth patterns P4 formed on the recording medium M deviate in sequence from the respective sub-patterns of the second patterns P2 by the second deviation amount. The fine adjustment patterns Pd each include one or more cycles of such periodic changes.

Hence, the recording apparatus 1 of this embodiment causes the rough adjustment pattern Pr, including the first pattern P1 and the third pattern P3, and the fine adjustment patterns Pd, including the second patterns P2 and the fourth patterns P4, to be formed concurrently with forward and backward motion of the recording head 4 at a time. Accordingly, one operation of forming adjustment patterns allows both the rough adjustment pattern Pr and the fine adjustment patterns Pd to be formed, thereby shortening the time to adjust the positions of ink droplets on the recording medium M.

The positions of ink droplets on the recording medium M are conventionally adjusted by forming the rough adjustment pattern Pr for major adjustment and then forming fine adjustment patterns Pd for minor adjustment. This is because each fine adjustment pattern Pd, which is highly accurate, gives a small adjustment area and therefore the small adjustment area does not fall every time within the intended area unless major adjustment is performed before formation of the fine adjustment patterns Pd. Accordingly, adjustment of the positions of ink droplets on the recording medium M may not be achieved only with the fine adjustment patterns Pd. Naturally, the adjustment accuracy decreases only with adjustment using the rough adjustment pattern Pr.

In contrast, in the recording apparatus 1 of this embodiment, the positions of the sub-patterns of the rough adjustment pattern Pr and those of each fine adjustment pattern Pd in the first directions are associated with each other, and each fine adjustment pattern Pd exhibits the image density that periodically changes along the first directions and includes one or more cycles of such periodic changes. In other words, use of the rough adjustment pattern Pr enables adjustment of the positions of ink droplets on the recording medium M within a larger adjustment area, while use of the fine adjustment patterns Pd enables highly accurate adjustment within the adjustment area related to the rough adjustment pattern Pr.

Consequently, the recording apparatus 1 of this embodiment accomplishes highly accurate adjustment of the positions of ink droplets on the recording medium M and shortens the time required for the adjustment.

It should be noted that each fine adjustment pattern Pd of this embodiment includes about two cycles of changes as described above and preferably each fine adjustment pattern Pd includes two or more cycles of changes. This is aimed at extending the adjustment area, which resides in the fine adjustment patterns Pd and is related to the rough adjustment pattern Pr, in the first directions and increasing at least one of the area and accuracy for the adjustment of the positions of ink droplets on the recording medium M.

As illustrated in FIG. 4 and FIGS. 5A and 5B, the fine adjustment patterns Pd of this embodiment are disposed on both sides of the rough adjustment pattern Pr in the second direction (transport direction A). In other words, a plurality of (at least two) fine adjustment patterns Pd can be formed. The fine adjustment patterns Pd, which are used for highly accurate adjustment, are prone to variations. Since adjustment using data on a plurality of portions can give high accuracy, forming a plurality of fine adjustment patterns Pd enables particularly highly accurate adjustment of the positions of ink droplets on the recording medium M.

In this embodiment, as illustrated in FIGS. 6A and 6B, the nozzle lines N are divided into five groups: G1, G2, G3, G4 and G5 along the second direction (transport direction A). The groups G1 and G2 constitute second patterns P2 and fourth patterns P4, the group G3 constitutes a first pattern P1 and a third pattern P3, and the groups G4 and G5 constitute second patterns P2 and fourth patterns P4. Accordingly, the adjustment pattern P undergoes group-by-group image density detection by the sensor 16 for the five groups: G1, G2, G3, G4, and G5 corresponding to the respective regions. In other words, this embodiment involves formation of four fine adjustment patterns Pd.

Alternatively, rough adjustment patterns Pr may be disposed on both sides of a fine adjustment pattern Pd in the second direction. This structure allows the fine adjustment pattern Pd to be formed with nozzles in a middle part of each nozzle line N. When the fine adjustment pattern Pd, which is used for highly accurate adjustment, is formed with nozzles in the middle part, which barely cause variations, the adjustment accuracy tends to increase. For this reason, this structure enables particularly highly accurate adjustment of the positions of ink droplets on the recording medium M.

In the recording apparatus 1 of this embodiment, the positions of the sub-patterns of the rough adjustment pattern Pr and those of the fine adjustment patterns Pd in the first directions can be described as being associated with each other so that a selection area D1 in each fine adjustment pattern Pd can be selected according to the selection of a selection position S1 in the rough adjustment pattern Pr. Moreover, it can be described that the controlling unit 11 sets the adjustment value based on data representing a reference value (a data value indicating the position (data number) of the sub-pattern with the lowest image density within the selection area D1) within the selection area D1 in each fine adjustment pattern Pd. In other words, with such a structure, the recording apparatus 1 of this embodiment selects a selection position in the rough adjustment pattern Pr to readily select a selection area in each fine adjustment pattern Pd.

Figure 7A:
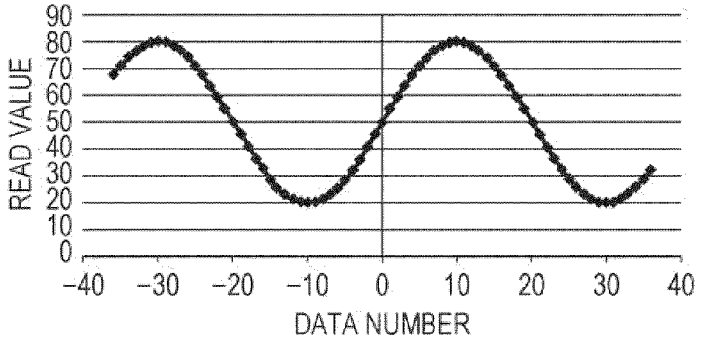
FIGS. 7A to 7C are schematic diagrams for explaining an example method of adjusting ejected-droplet positions for the recording apparatus according to an embodiment of the invention.
Figure 7B:
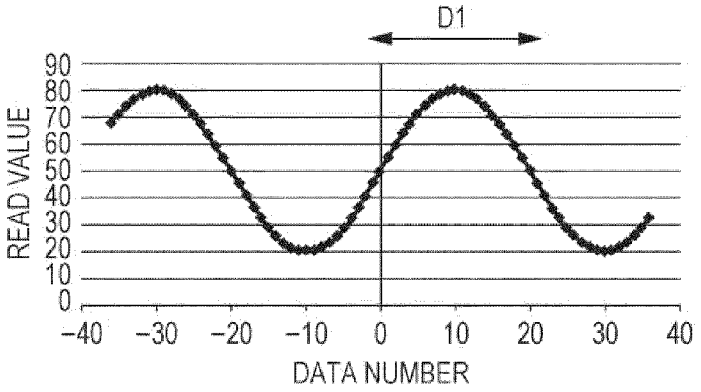
Figure 7C:
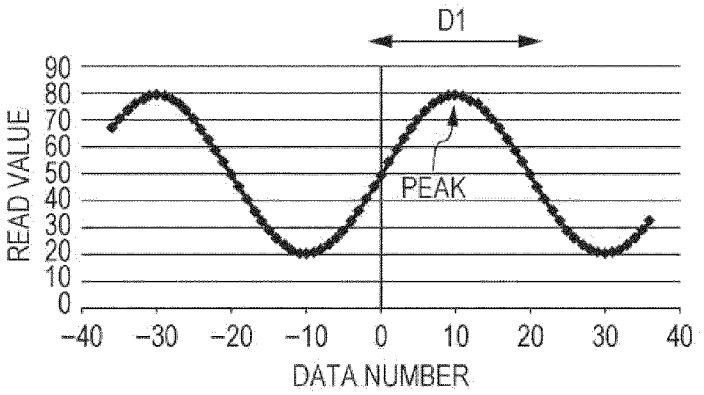

This is explained with reference to FIGS. 7A to 7C. The controlling unit 11 can derive an equation (periodic equation) in which the values read by the sensor 16 are associated with the data numbers for the respective sub-patterns of the fine adjustment patterns Pd. FIG. 7A is a graph of this equation. As illustrated in FIG. 7B, the controlling unit 11 then determines the data numbers that fall within a selection area D1 in each fine adjustment pattern Pd, according to the selection position S1 selected based on the read values in the rough adjustment pattern Pr. As illustrated in FIG. 7C, the controlling unit 11 then determines, by using the equation, the peak position (the position (data number) of the sub-pattern with the lowest image density) within the selection area D1 in each fine adjustment pattern Pd.

It should be noted that in FIGS. 7A to 7C and the following FIGS. 8A to 8C and FIGS. 9A to 9C, a higher read value indicates a lower image density.

Moreover, in the recording apparatus 1 of this embodiment, the selection area D1 in each fine adjustment pattern Pd dependent on the selection position S1 in the rough adjustment pattern Pr is changeable. This will be explained in detail referring to FIGS. 8A to 8C.

Figure 8A:
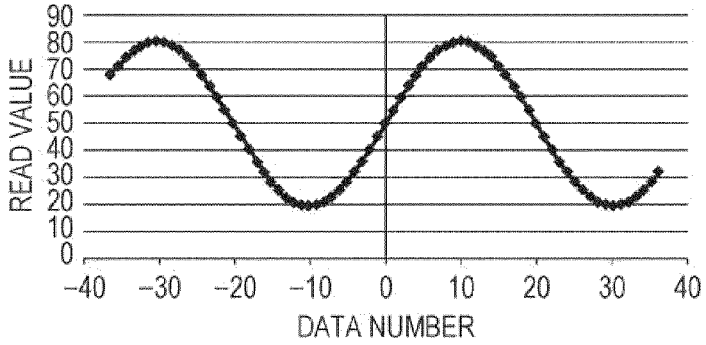
FIGS. 8A to 8C are schematic diagrams for explaining the example method of adjusting ejected-droplet positions for the recording apparatus according to an embodiment of the invention.
Figure 8B:
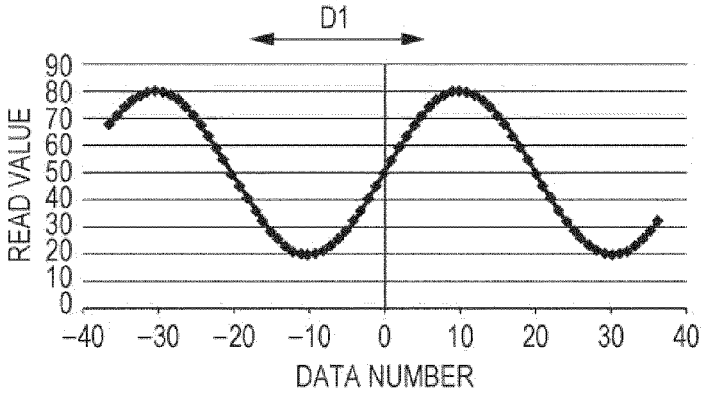
Figure 8C:
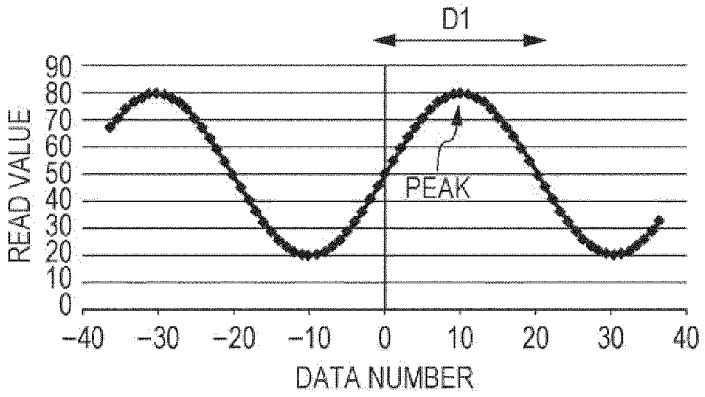

FIG. 8A is a graph of an equation in which the values read by the sensor 16 are associated with the data numbers in each fine adjustment pattern Pd. When the selection area D1 in each fine adjustment pattern Pd associated with the selection position S1 as illustrated in FIG. 8B deviates from the peak position of the quadratic curve, the selection area D1 in each fine adjustment pattern Pd associated with the selection position S1 can be changed as illustrated in FIG. 8C. Accordingly, when a selection area D1 in the fine adjustment pattern Pd is not appropriately selected based on the selection position S1 in the rough adjustment pattern Pr, the selection area D1 dependent on the selection position S1 can be changed to an appropriate area. This enables particularly highly accurate adjustment of the positions of ink droplets on the recording medium M.

Alternatively, the controlling unit 11 in the recording apparatus 1 of this embodiment can set the adjustment value using information on periodic changes (periodic curve)

outside of a selection area D1 in the fine adjustment pattern Pd. This will be explained in detail referring to FIGS. 9A to 9C.

Figure 9A:
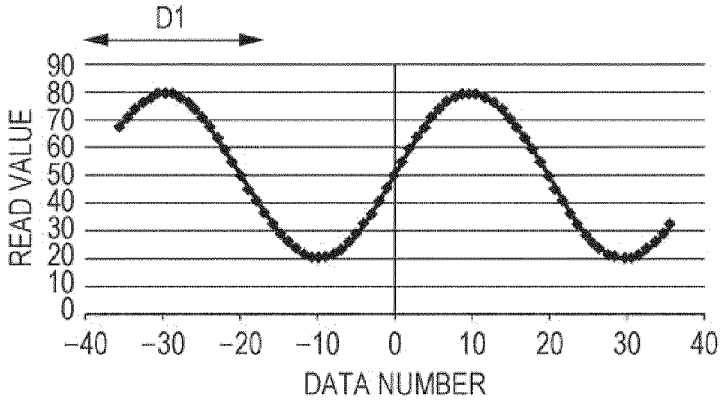
FIGS. 9A to 9C are schematic diagrams for explaining the example method of adjusting ejected-droplet positions for the recording apparatus according to an embodiment of the invention.
Figure 9B:
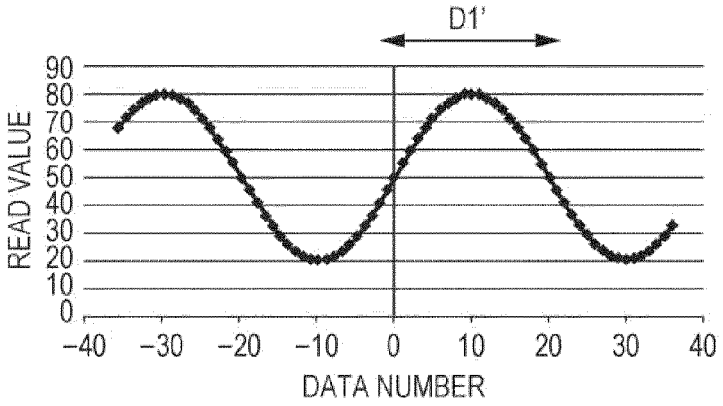
Figure 9C:
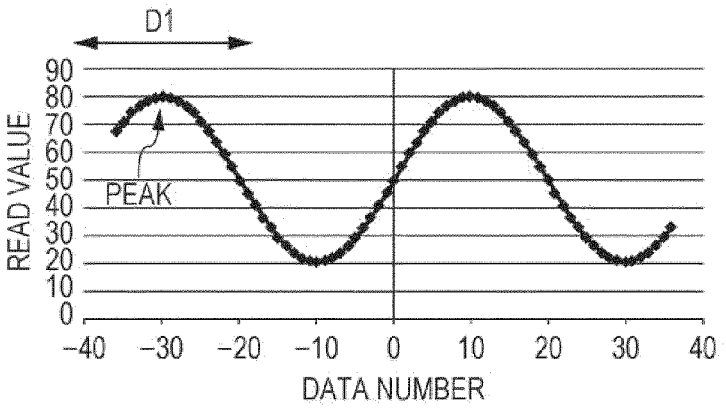

FIG. 9A illustrates the case where a selection area D1 in the fine adjustment pattern Pd selected according to the selection of a selection position S1 in the rough adjustment pattern Pr is not large enough to set an appropriate adjustment value (the case where the data on the negative side in the drawing is insufficient). To be specific, the drawing illustrates the case where the selection area D1 cannot provide enough data to specify (to allow the controlling unit 11 to calculate) the data number corresponding to the peak position. In this case, as illustrated in FIG. 9B, the controlling unit 11 determines an area deviating from the selection area D1 in the fine adjustment pattern Pd by one phase to be a virtual selection area D1'. The controlling unit 11 then performs calculation to specify the data number corresponding to the peak position within the virtual selection area D1', determines the reference value (information used to determine the data number corresponding to the peak position) that reflects the results given by information on the virtual selection area D1' outside of the selection area D1 (which is information that is different from the initial information on the selection area D1), and then, as illustrated in FIG. 9C, specifies the data number corresponding to the appropriate peak position (sets the appropriate adjustment value). This enables particularly highly accurate adjustment of the positions of ink droplets on the recording medium M.

An embodiment of a method of adjusting ejected-droplet positions using the recording apparatus 1 of the embodiment will now be explained.

Figure 10:
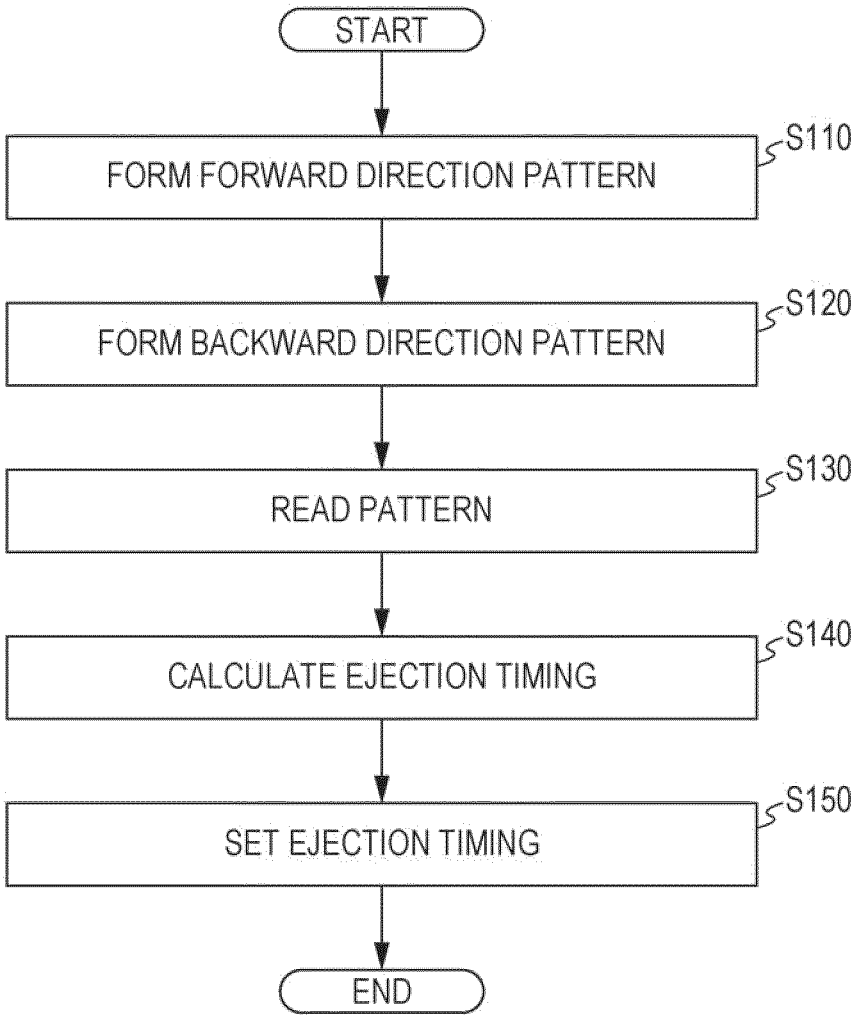
FIG. 10 is a flow chart of the method of adjusting ejected-droplet positions according to an embodiment of the invention.

FIG. 10 is a flowchart of the method of adjusting ejected-droplet positions of this embodiment.

Upon starting the method of adjusting ejected-droplet positions of this embodiment initiated, for example, by a user, a forward direction pattern including a first pattern P1 and second patterns P2 which includes a plurality of sub-patterns arranged in the first directions is first formed on the recording medium M in Step S110 while ink droplets are ejected from the recording head 4 and the recording head 4 is moved in the forward direction B1.

In Step S120, a backward direction pattern is formed on the recording medium M by forming a third pattern P3, which has sub-patterns deviating in sequence from the respective sub-patterns of the first pattern P1 in the first directions by the first deviation amount, and fourth patterns P4, each of which has sub-patterns deviating in sequence from the respective sub-patterns of the second pattern P2 in the first directions by the second deviation amount smaller than the first deviation amount, on the recording medium M while ink droplets are ejected from the recording head 4 and the recording head 4 is moved in the backward direction B2.

In Step S130, an adjustment pattern P including the forward direction pattern and the backward direction pattern is read with the sensor 16.

In Step S140, the controlling unit 11 selects a selection position S1 according to the results of the reading operation with the sensor 16, sets a selection area D1, determines a peak position (reference value) within the selection area D1 in the fine adjustment pattern Pd, and calculates an ejection timing (adjustment value) based on the peak position.

In Step S150, the controlling unit 11 sets an ejection timing (adjustment value) according to the calculation made in Step S140.

To explain this in another way, the method of adjusting ejected-droplet positions of this embodiment uses the recording apparatus 1 that includes the recording head 4 that has nozzle lines N that eject ink droplets and that can move forward and backward in the first directions (direction B) intersecting the nozzle lines N, and the pair of transporting rollers 5 that transports the recording medium M in the second direction (transport direction A) intersecting the first directions (i.e., causes the recording medium M and the recording head 4 to move relatively to each other).

The method includes a forward pattern forming step (Step S110) of forming a first pattern P1 and second patterns P2, which have a plurality of sub-patterns arranged in the first directions, on the recording medium M while ink droplets are ejected from the recording head 4 and the recording head 4 is moved in the forward direction B1, and a backward pattern forming step (Step S120) of forming a third pattern P3, which has sub-patterns deviating in sequence from the respective sub-patterns of the first pattern P1 in the first directions by the first deviation amount, and fourth patterns P4, each of which has sub-patterns deviating in sequence from the respective sub-patterns of the second patterns P2 in the first directions by the second deviation amount smaller than the first deviation amount, on the recording medium M while ink droplets are ejected from the recording head 4 and the recording head 4 is moved in the backward direction B2. Here, the positions of the sub-patterns of the rough adjustment pattern Pr, including the first pattern P1 and the third pattern P3, and those of the fine adjustment patterns Pd, including the second patterns P2 and the fourth patterns P4, in the first directions are associated with each other. In each fine adjustment pattern Pd, the image density periodically changes along the first directions in accordance with deviation of the sub-patterns of the fourth patterns P4 formed on the recording medium M in sequence from the respective sub-patterns of the second patterns P2 by the second deviation amount. The fine adjustment patterns Pd each include one or more cycles of such periodic changes.

The method of adjusting ejected-droplet positions of this embodiment achieves highly accurate adjustment of the positions of ink droplets on the recording medium M and shortens the time required for the adjustment.

It should be understood that the invention should not be limited to these embodiments and various modifications can be made without departing from the scope of the invention defined by the claims and the modifications should also be included in the scope of the invention.

This application claims priority under 35 U.S.C. §119 to Japanese Patent Application No. 2015-179646, filed Sep. 11, 2015. The entire disclosure of Japanese Patent Application No. 2015-179646 is hereby incorporated herein by reference.

What is claimed is:

1. A liquid ejecting apparatus comprising:

an ejector that includes nozzle lines that eject liquid droplets and is movable forward and backward in first directions intersecting the nozzle lines;

a moving unit that causes a medium and the ejector to move relatively to each other in a second direction intersecting the first directions; and a controlling unit that is operated to form a first pattern and second patterns, having a plurality of sub-patterns arranged in the first directions, on the medium while the liquid droplets are ejected from the ejector and the ejector is moved in a forward direction of the first directions, and to form a third pattern and fourth patterns on the medium while the liquid droplets are ejected from the ejector and the ejector is moved in a backward direction of the first directions, the third pattern having sub-patterns deviating in sequence from the respective sub-patterns of the first pattern in the first directions by a first deviation amount, the fourth patterns each having sub-patterns deviating in sequence from the respective sub-patterns of the second patterns in the first directions by a second deviation amount smaller than the first deviation amount, wherein positions of sub-patterns of at least one rough adjustment pattern, including the first pattern and the third pattern, and positions of sub-patterns of fine adjustment patterns, including the second patterns and the fourth patterns, in the first directions are associated with each other, and in each fine adjustment pattern, image density periodically changes along the first directions in accordance with deviation of the sub-patterns of the fourth patterns formed on the medium in sequence from the respective sub-patterns of the second patterns by the second deviation amount, and the fine adjustment patterns each include one or more cycles of the periodic changes.

2. The liquid ejecting apparatus according to claim 1, wherein the fine adjustment patterns each include two or more cycles of the periodic changes.

3. The liquid ejecting apparatus according to claim 1, wherein the fine adjustment patterns are disposed on both sides of the at least one rough adjustment pattern in the second direction.

4. The liquid ejecting apparatus according to claim 1, wherein the at least one rough adjustment pattern includes a plurality of rough adjustment patterns that are disposed on both sides of the fine adjustment pattern in the second direction.

5. The liquid ejecting apparatus according to claim 1, wherein the positions of the sub-patterns of the at least one rough adjustment pattern and the positions of the sub-patterns of the fine adjustment patterns in the first directions are associated with each other such that a selection area in each fine adjustment pattern is selected according to selection of a selection position in the at least one rough adjustment pattern, and the controlling unit sets an adjustment value based on a reference value within the selection area.

6. The liquid ejecting apparatus according to claim 5, wherein the selection area dependent on the selection position is changeable.

7. The liquid ejecting apparatus according to claim 5, wherein the controlling unit sets the adjustment value by determination of the reference value given by information on the periodic changes outside of the selection area.

8. A method of adjusting ejected-droplet positions, the method using a liquid ejecting apparatus including an ejector that includes nozzle lines that eject liquid droplets and is movable forward and backward in first directions intersecting the nozzle lines and a moving unit that causes a medium and the ejector to move relatively to each other in a second direction intersecting the first directions, the method comprising:

forming a forward direction pattern including a first pattern and second patterns, having a plurality of sub-patterns arranged in the first directions, on the medium while the liquid droplets are ejected from the ejector and the ejector is moved in a forward direction of the first directions; and forming a backward direction pattern including a third pattern and fourth patterns on the medium while the liquid droplets are ejected from the ejector and the ejector is moved in a backward direction of the first directions, the third pattern having sub-patterns deviating in sequence from the respective sub-patterns of the first pattern in the first directions by a first deviation amount, the fourth patterns each having sub-patterns deviating in sequence from the respective sub-patterns of the second patterns in the first directions by a second deviation amount smaller than the first deviation amount, wherein positions of sub-patterns of at least one rough adjustment pattern, including the first pattern and the third pattern, and positions of sub-patterns of fine adjustment patterns, including the second patterns and the fourth patterns, in the first directions are associated with each other, and in each fine adjustment pattern, image density periodically changes along the first directions in accordance with deviation of the sub-patterns of the fourth patterns formed on the medium in sequence from the respective sub-patterns of the second patterns by the second deviation amount, and the fine adjustment patterns each include one or more cycles of the periodic changes.

* * * * *